US007789981B1

(12) United States Patent
Busse et al.

(10) Patent No.: US 7,789,981 B1
(45) Date of Patent: Sep. 7, 2010

(54) DESENSITIZATION AND RECOVERY OF METASTABLE INTERMOLECULAR COMPOSITES

(75) Inventors: James R. Busse, South Fork, CO (US); Robert C. Dye, Los Alamos, NM (US); Timothy J. Foley, Los Alamos, NM (US); Kelvin T. Higa, Ridgecrest, CA (US); Betty S. Jorgensen, Jemez Springs, NM (US); Victor E. Sanders, White Rock, NM (US); Steven F. Son, Los Alamos, NM (US)

(73) Assignee: The United States of America as represented by the United States Department of Energy, Washington, DC (US)

( * ) Notice: Subject to any disclaimer, the term of this patent is extended or adjusted under 35 U.S.C. 154(b) by 193 days.

(21) Appl. No.: 11/845,259

(22) Filed: Aug. 27, 2007

Related U.S. Application Data

(62) Division of application No. 11/492,817, filed on Jul. 26, 2006.

(51) Int. Cl.
*C06B 27/00* (2006.01)
*D03D 23/00* (2006.01)
*D03D 43/00* (2006.01)

(52) U.S. Cl. ..... 149/87; 149/108.8; 149/109.2; 149/109.4; 149/109.6

(58) Field of Classification Search ..... 149/88, 149/109.6, 87, 108.8, 109.2, 109.4
See application file for complete search history.

(56) References Cited

U.S. PATENT DOCUMENTS

| | | | | |
|---|---|---|---|---|
| 3,386,868 | A * | 6/1968 | Gimler et al. | 149/19.91 |
| 3,421,441 | A * | 1/1969 | Mardarello et al. | 102/204 |
| 5,717,159 | A | 2/1998 | Dixon et al. | |
| 6,423,151 | B1 * | 7/2002 | Gonzalez et al. | 134/10 |
| 2006/0178459 | A1 * | 8/2006 | Matsuda et al. | 524/263 |

OTHER PUBLICATIONS

3M Performance Materials, "Fluorinert Liquids for Electronic Reliability Testing", 3M IPC document 98-0212-2305-6 (HB) with Frequently Asked Questions, (2000).

* cited by examiner

*Primary Examiner*—Jerry Lorengo
*Assistant Examiner*—James E McDonough
(74) *Attorney, Agent, or Firm*—Thomas S. O'Dwyer; James C. Durkis

(57) ABSTRACT

A method to substantially desensitize a metastable intermolecular composite material to electrostatic discharge and friction comprising mixing the composite material with an organic diluent and removing enough organic diluent from the mixture to form a mixture with a substantially putty-like consistency, as well as a concomitant method of recovering the metastable intermolecular composite material.

11 Claims, 2 Drawing Sheets

DESENSITIZATION AND RECOVERY OF METASTABLE INTERMOLECULAR COMPOSITES

CROSS-REFERENCE TO RELATED APPLICATIONS

This application is a divisional of copending application Ser. No. 11/492,817 filed Jul. 26, 2006, the entire contents of which are hereby incorporated by reference. The present invention's method for desensitizing and recovering metastable intermolecular composites has been assigned to class 149, subclass 109.6.

STATEMENT REGARDING FEDERALLY SPONSORED RESEARCH OR DEVELOPMENT

The U.S. Government has rights in this invention pursuant to the terms and conditions of Contract No. W-7405-ENG-36 awarded by the U.S. Department of Energy to Los Alamos National Laboratory.

BACKGROUND OF THE INVENTION

1. Field of the Invention (Technical Field)

The present invention relates to methods to desensitize metastable intermolecular composite materials.

2. Description of Related Art

Metastable Intermolecular Composites (MICs) are materials comprised of nanoscale composite energetic materials, often a metal and an oxidizer. Similar in composition to classical composites, MICs differ in that the individual particle sizes are on the nanometer scale ($10^{-9}$ m) instead of millimeter or sub-millimeter ($10^{-4}$ m to $10^{-3}$ m). This significant change in spatial scale significantly changes the chemical and mechanical properties, enabling a new set of behaviors. For example, instead of burning at tens of millimeters per second, MICs are capable of combustion velocities of tens of meters per second up to kilometers per second. These differences make these a new class of materials.

These materials have found a variety of possible applications including as electric and percussion igniters or primers. See, for example, U.S. Pat. No. 5,717,159 for percussion primers. However, a significant practical issue limits their widespread and scaled production. This issue is the sensitivity of these nanoscale materials to electrostatic discharge (ESD) and friction. For applications such as lead-free igniters or primers, the sensitivity is needed for the application to work. Specifically, a small hot spot caused by the heating of the bridgewire must be sufficient to ignite the mixture in an electric igniter. Similarly, the material must be friction sensitive enough to be reliably ignitable by the action in a percussion primer. Ideally what is needed is a material that can be desensitized to friction and ESD so that large amounts of the material can be handled, yet re-sensitized when configured in the final desired application for the particular material.

While other processes may achieve similar results (such as a hydrous process involving modification of nanoscale aluminum to reduce MIC sensitivity), these require more complex processing, especially to produce a MIC material of as high a quality as the starting MIC material. Furthermore, the present invention permits the undisturbed use of organic polymers in conjunction with the MIC material.

BRIEF SUMMARY OF THE INVENTION

The present invention is of a method to substantially desensitize a metastable intermolecular composite material to electrostatic discharge and friction, comprising: mixing the composite material with an organic diluent; and removing enough organic diluent from the mixture to form a mixture with a substantially putty-like consistency. In the preferred embodiment, mixing comprises mixing the composite material with an anhydrous, inflammable solvent, preferably one or more of fluorinated, chlorinated, or bromated, most preferable either one that is fully one or more of fluorinated, chlorinated, or bromated (e.g., a Fluorinert™ fluid) or that is a hydrofluoroether (e.g., a Novec™ fluid). The diluent preferably has a vapor pressure less than approximately 10 torr, most preferably between approximately 1 and 5 torr.

The invention is also of a method to recover a metastable intermolecular composite material substantially desensitized to electrostatic discharge and friction, comprising: receiving a mixture of the composite material and an organic diluent; and removing substantially all of the organic diluent.

The invention is further of a method to substantially desensitize and then recover a metastable intermolecular composite material, comprising: mixing the composite material with an organic diluent; removing enough organic diluent from the mixture to form a mixture with a substantially putty-like consistency; and removing substantially all of the organic diluent. In the preferred embodiment, mixing comprises mixing the composite material with an anhydrous, inflammable solvent, preferably one or more of fluorinated, chlorinated, or bromated, most preferable either one that is fully one or more of fluorinated, chlorinated, or bromated (e.g., a Fluorinert™ fluid) or that is a hydrofluoroether (e.g., a Novec™ fluid). The diluent preferably has a vapor pressure less than approximately 10 torr, most preferably between approximately 1 and 5 torr. Removing preferably comprises drying.

Objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

LED DESCRIPTION OF THE INVENTION

Figure 1:
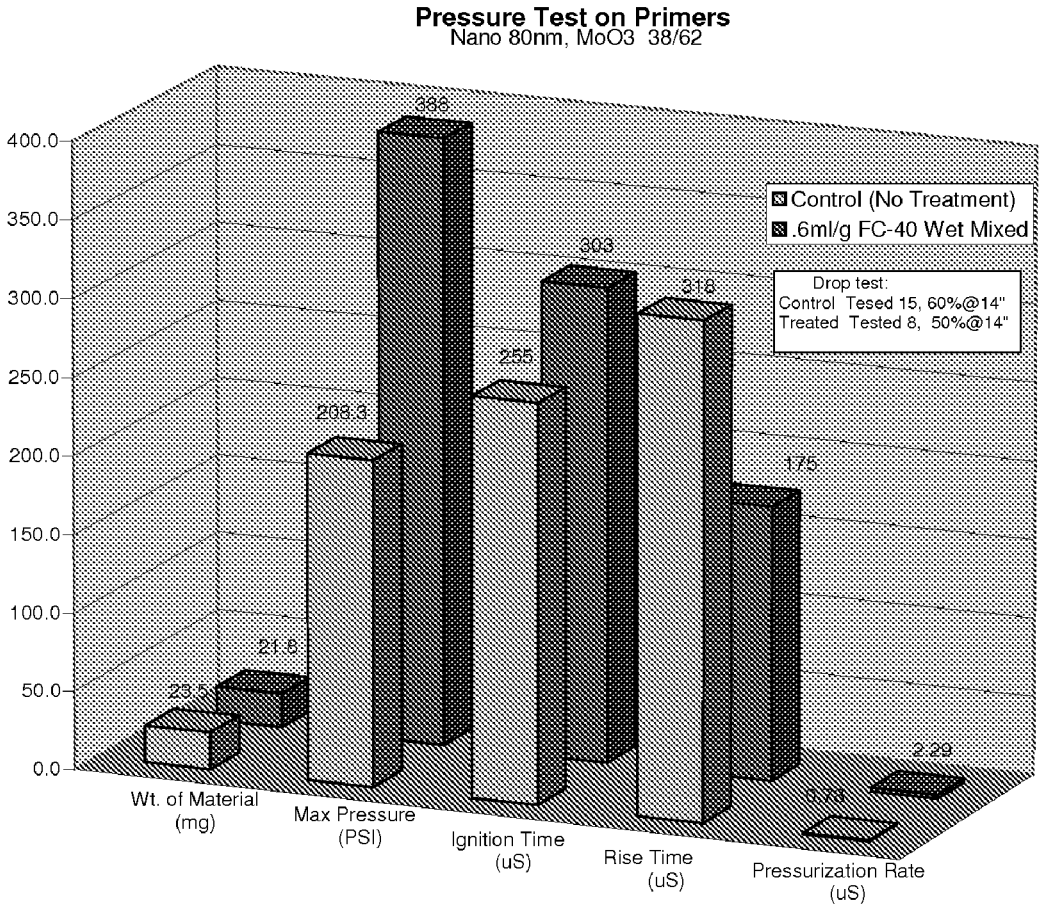
FIG. 1 shows pressure test results on MIC primers both treated and recovered according to the invention and untreated.

The present invention describes a method to desensitize a MIC material until it is configured into a final application. By keeping the material wetted with an appropriate solvent the material can be rendered insensitive to friction and ESD. Reaction will not propagate in the wetted material. In addition, one can press this desensitized material into a primer and then remove the solvent by drying to yield a fully functional primer, as good and often better in quality than the starting material.

The solvent can be any organic diluent, preferably with a relatively low boiling point and high volatility. However, many such diluents are flammable. The preferred solvents for use with the invention are anhydrous, inflammable solvents such as fluorinated, chlorinated, and/or bromated solvents, more preferably fully fluorinated, chlorinated, and/or bromated solvents such as the Fluorinert™ fluids available from Minnesota Mining and Manufacturing Corporation (3M), or hydrofluoroethers such as the Novec™ fluids from 3M (which do not have high global warming potentials). Most preferred are such solvents having vapor pressures of less than approximately 10 torr, most preferably approximately 1-5 torr. Solvents with such vapor pressures provide sufficient speed and controllability of evaporation.

One embodiment that demonstrates the desensitization of MIC according to the present invention employs Fluorinert™ FC-40, a perfluorinated liquid having a vapor pressure of 3 torr. Fluorinert FC-40 is useful because of its low flammability in air and acceptable volatility. One can mix, for example, a MIC composite of nano-aluminum and $MoO_3$ in hexane and FC-40. The hexane is much more volatile than the FC-40 and therefore the hexane can be removed by rough drying while leaving the MIC and FC-40 mixture.

Such a mixture, with sufficient FC-40, will not allow flame propagation. Furthermore, ESD and friction tests show that the resulting mixture is desensitized. Test results are shown in Table 1 and 2. The mixtures considered were: 1) 0.76 cc/g, 2) 0.7 cc/g, and 3) 0.54 cc/g FC-40 to final MIC material. These results demonstrate that acceptable ESD and friction sensitivities can be achieved by the present invention,

TABLE 1

Human Electrostatic Discharge Sensitivity Testing
(Spark gap of 0.085 in. and foil thickness of 0.003 in. at 15.24 kv)

| Sample | 50% Energy (J) | No Goes | Goes | % RH | Temp (° C.) |
|---|---|---|---|---|---|
| FC-40/MIC #1 | 0.36 | 13 | 0 | 19.1 | 21.3 |
| FC-40/MIC #2 | 0.36 | 13 | 0 | 19.1 | 21.3 |
| FC-40/MIC #3 | 0.36 | 13 | 0 | 19.1 | 21.3 |
| PETN Standard (0601-012) Batch RPS-3518 | 0.36 | 13 | 0 | 20.5 | 21.3 |

TABLE 2

Friction Sensitivity Testing
(The 50% load in kg determined using "Bruceton up/down method)

| Sample | 50% Load in kg | Log Units | % RH | Temp (° C.) |
|---|---|---|---|---|
| FC-40/MIC #1 | 7.2 | 8.04* | 22.1 | 19.0 |
| FC-40/MIC #2 | 3.1 | 1.50 | 22.3 | 18.5 |
| FC-40/MIC #3 | 1.2 | 1.20 | 22.4 | 19.0 |
| PETN Standard (0601-012) Batch RPS-3518 | 6.0 | 1.37 | 19.6 | 22.0 |

*Range varied from 14.4 kg at start of test to 2.4 at end of test.

Figure 2:
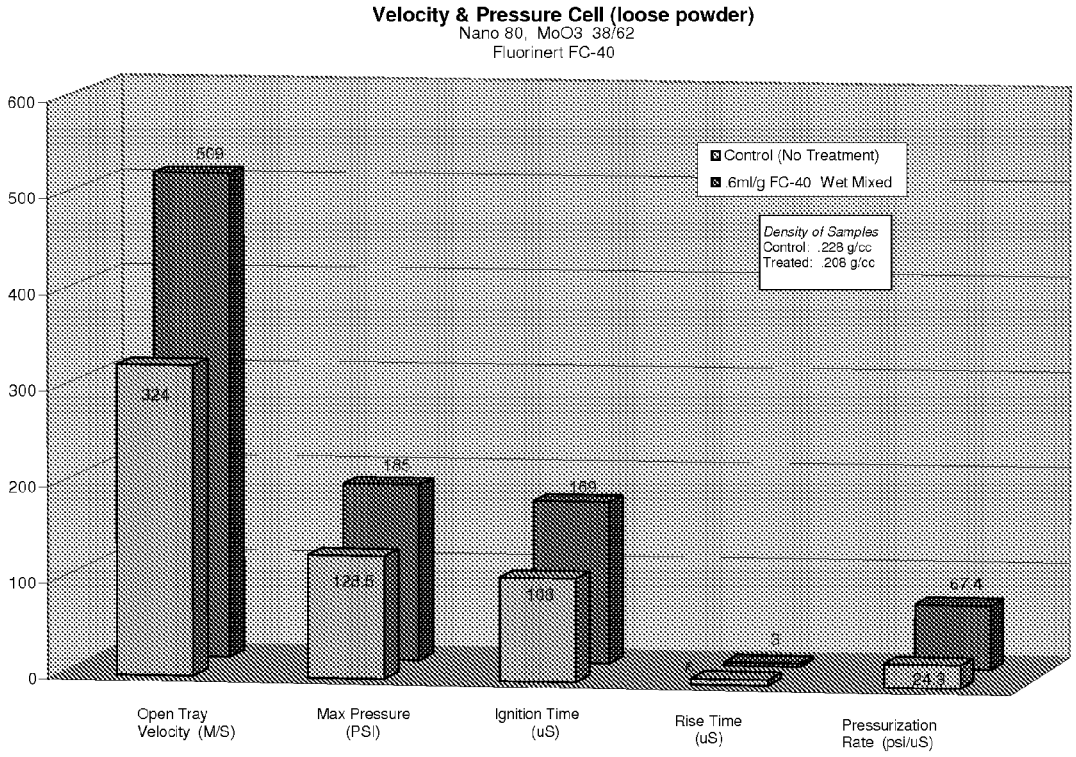
FIG. 2 is shows pressure and burn test results on MIC powders both treated and recovered according to the invention and untreated.

In addition, performance of the MIC material can be restored by drying the MIC once it is in a primer configuration or in loose powder. FIGS. 1 and 2 show performance of the materials above as determined by close bomb tests and open tray burning rate. The treated material meets or exceeds the standard materials.

In short, one can desensitize and then recover the performance of MIC materials. This allows widescale application of MIC materials because the materials can now be scaled and handled.

Further details on manner of processing are next provided in the context of the example materials described above.

Using Nanotechnologies 80 nm aluminum and Climax $MoO_3$ and an optimum ratio of 38/62, dry components were weighed and combined with 15 ml of Hexane and 2 ml of Fluorinert FC-40. The material was sonicated with a sonic horn for 30 seconds. The petri dish was weighed and recorded and tared. The slurry was poured into the dish and rough dried on hot plate in a vent hood. When the material showed little sign of wetness, the petri dish was moved to a small vacuum/oven.

The concentration of FC-40/MIC is calculated as follows: An estimate of actual MIC is needed. Through experience it is known that a 1 gram batch processed through standard procedures results in 0.95 g of material. The density of FC-40 is 1.87 g/cc. For this example, the target concentration was 0.6 cc/g of MIC or 1.122 mg of FC/1 gram of MIC. Add the weight of the tare, the MIC and the FC-40. This will be the gross target weight.

A rough vacuum (23"Hg) was pulled and the oven heated to about 40° C. By checking the gross weight every few minutes, one can get a feel on when one is approaching the target weight. Note that heat accelerates the drying time and is the biggest contributor to the drying process and therefore should be regulated very closely. When the target weight is achieved, the semi-dried material can be harvested. A glove box with an open container of FC-40 is recommended to harvest. The more surface area of FC-40 the better. One can use a long tray (as a space saver) and a Kim-Wipe as a wick to get to a saturated state. Previous experience has shown that the uptake of FC-40 will make the FC-40/MIC ratio increase. This is a slow process and should not be an issue if the material is harvested and sealed in the same day.

Harvesting the material is identical to the standard procedure used to harvest regular MIC. The material is brushed through a sieve with more intensity due to the consistency of the material (putty like).

The saturated environment of the glove box is also where the primer cup loading takes place. Loading the desensitized material is the same as with the sensitive material. Pouring an amount of material on top of the die and scrapping it over the holes with a single edged blade. Simply tapping the full die on a hard surface multiple times produces compression much as the vibrators did. Add more material and scrap level, tap again and repeat. For the above concentration, a typical amount of material is 21.8 mg (dried weight) compared to an untreated primer of 23.5 mg. The push rods are started and the assembly is removed to the hydraulic press for final pressing. The rest of the loading procedure is identical to non-treated primer construction and does not require the glove box environment. An amount of FC is squeezed out of the material during pressing and is obvious by the wet spots left on the die base and the "mud" residue left on the pins and die barrel.

To obtain an accurate weight of material in each cup, note the weight of the cup and anvil, the total wet weight before drying and a final dry weight. Having these numbers one can calculate the actual amount/ratio of FC to MIC. The primers made have an average of 0.476 cc/g. The FC-40 has to be removed completely by vacuum/heat as before. This takes approximately 4 hours at 40°-45° C. and can be monitored as before to assure complete drying. Through previous tests, and taking into account the sensitivity of the scale, all the FC-40 can be removed.

Evidence of condensation on the vacuum/ovens glass door indicates that the recovering of the FC-40 should not be a problem.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A method to substantially desensitize a metastable intermolecular composite material to electrostatic discharge and friction, the method comprising the steps of:

mixing the composite material with a hexane solvent and a non-flammable anhydrous organic co-solvent;

removing enough of the hexane solvent from the mixture to form a mixture with a putty-like consistency;

configuring the wet mixed material into a final application form; and removing substantially all of the remaining solvent diluent to yield a fully functional energetic composite material.

2. The method of claim 1 wherein the mixing step comprises mixing the composite material with a hexane solvent and a co-solvent that is one or more partially fluorinated, chlorinated, or bromated.

3. The method of claim 2 wherein the mixing step comprises mixing the composite material with a hexane solvent and a co-solvent that is one or more fully fluorinated, chlorinated, or bromated.

4. The method of claim 3 wherein the mixing step comprises mixing the composite material with a hexane solvent and a perfluorocarbon co-solvent.

5. The method of claim 2 wherein the mixing step comprises mixing the composite material with a hexane solvent and a co-solvent that is a fluorinated ether.

6. The method of claim 5 wherein the mixing step comprises mixing the composite material with a hexane solvent and a hydrofluoroether co-solvent.

7. The method of claim 1 wherein the mixing step comprises mixing the composite material with co-solvent diluents that have a vapor pressure less than approximately 10 torr.

8. The method of claim 7 wherein the mixing step comprises mixing the composite material with co-solvent diluents that have a vapor pressure between approximately 1 and 5 torr.

9. The method of claim 1 wherein the step of configuring the wet mixed material occurs, partly or wholly, in an enclosed environment that is saturated with said anhydrous co-solvent.

10. The method of claim 1 wherein the step of removing the hexane solvent comprises vented drying.

11. The method of claim 1 wherein the step of removing all of the remaining solvent is by vacuum oven.

* * * * *